US010730172B2

(12) United States Patent
Po

(10) Patent No.: US 10,730,172 B2
(45) Date of Patent: Aug. 4, 2020

(54) PNEUMATIC NAIL GUN AND A NAIL-STRIKING PIN DEVICE THEREOF

(71) Applicant: BASSO INDUSTRY CORP., Taichung (TW)

(72) Inventor: Chien-Kuo Po, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 135 days.

(21) Appl. No.: 16/175,892

(22) Filed: Oct. 31, 2018

(65) Prior Publication Data

US 2019/0126453 A1 May 2, 2019

(30) Foreign Application Priority Data

Nov. 2, 2017 (TW) ..... 106137862 A

(51) Int. Cl.
*B25C 1/04* (2006.01)
*B25C 1/06* (2006.01)

(52) U.S. Cl.
CPC ..... *B25C 1/047* (2013.01); *B25C 1/041* (2013.01); *B25C 1/06* (2013.01)

(58) Field of Classification Search
CPC ..... B25C 1/04–047; B25C 1/06; B25C 1/008; B25C 1/00–188; B25C 7/00
USPC ..... 227/129–131, 146–147, 142, 8
See application file for complete search history.

(56) References Cited

U.S. PATENT DOCUMENTS 2,933,290 A * 4/1960 Ryder, Jr. ..... E21B 7/021 173/148
3,589,588 A * 6/1971 Vasku ..... B25C 1/005 227/132
4,215,808 A * 8/1980 Sollberger ..... B25C 1/041 173/204
4,807,793 A * 2/1989 Ghibely ..... B25C 5/15 227/131
5,388,749 A * 2/1995 Davignon ..... B65C 7/006 227/67
7,152,774 B2 * 12/2006 Chen ..... B25C 1/06 227/131
7,334,715 B2 * 2/2008 Oda ..... B25C 1/06 173/178
2005/0082334 A1 * 4/2005 Hu ..... B25C 1/06 227/131
2005/0242154 A1 * 11/2005 Leimbach ..... B25C 1/06 227/131
2006/0027622 A1 * 2/2006 Sun ..... B25C 1/06 227/131

(Continued)

*Primary Examiner* — Dariush Seif
(74) *Attorney, Agent, or Firm* — Burris Law, PLLC

(57) ABSTRACT

A pneumatic nail gun includes a main body, a cylinder, a muzzle device, a lifting wheel, a piston, a lifting rod, and a nail-striking pin. The piston is movable between a striking position and a non-striking position. The lifting rod is connected to the piston, and has an engaging portion that is engaged with the lifting wheel such that rotation of the lifting wheel drives the piston to the non-striking position, and that is disengaged from the lifting wheel such that the piston is driven by air pressure inside the cylinder to the striking position. The nail-striking pin is connected removably and co-movably to the piston, is spaced apart from the lifting rod, and is adapted for striking a nail when the piston is at the striking position.

14 Claims, 8 Drawing Sheets

(56) References Cited

U.S. PATENT DOCUMENTS

| | | | | |
|---|---|---|---|---|
| 2006/0180631 | A1* | 8/2006 | Pedicini | B25C 1/06 227/130 |
| 2009/0090762 | A1* | 4/2009 | Leimbach | B25C 1/041 227/130 |
| 2011/0198381 | A1* | 8/2011 | McCardle | B25C 1/06 227/8 |
| 2014/0202724 | A1* | 7/2014 | Moore | B25C 1/042 173/46 |
| 2015/0061230 | A1* | 3/2015 | Mina | F16J 9/08 277/434 |
| 2015/0202755 | A1* | 7/2015 | Tanji | B25C 1/06 227/130 |
| 2015/0290786 | A1* | 10/2015 | Largo | B25C 1/008 227/8 |
| 2015/0352702 | A1* | 12/2015 | Chien | B25C 1/047 227/130 |
| 2016/0114470 | A1* | 4/2016 | Weigmann | B25C 1/047 227/8 |
| 2016/0229043 | A1* | 8/2016 | Wyler | B25C 1/06 |
| 2016/0288305 | A1* | 10/2016 | McCardle | B25C 1/06 |
| 2017/0001291 | A1* | 1/2017 | Schnell | B25C 1/00 |
| 2017/0190037 | A1* | 7/2017 | Sato | B25C 1/06 |
| 2017/0361441 | A1* | 12/2017 | Namouz | B25C 1/04 |
| 2018/0036870 | A1* | 2/2018 | Komazaki | B25C 1/047 |
| 2018/0085905 | A1* | 3/2018 | Adams | B25C 1/08 |
| 2018/0133877 | A1* | 5/2018 | Ueda | B25F 5/008 |
| 2018/0290279 | A1* | 10/2018 | Kobori | B25C 1/06 |
| 2019/0126453 | A1* | 5/2019 | Po | B25C 1/06 |
| 2019/0134795 | A1* | 5/2019 | Bauer | B25C 1/008 |
| 2019/0168366 | A1* | 6/2019 | Yasutomi | B25C 1/06 |
| 2019/0321955 | A1* | 10/2019 | Carrier | B25C 1/06 |

* cited by examiner

PNEUMATIC NAIL GUN AND A NAIL-STRIKING PIN DEVICE THEREOF

CROSS-REFERENCE TO RELATED APPLICATION

This application claims priority of Taiwanese Patent Application No. 106137862, filed on Nov. 2, 2017.

FIELD

The disclosure relates to a pin device, more particularly to a nail-striking pin device for a pneumatic nail gun.

BACKGROUND

Referring to FIG. 1, a conventional pneumatic nail gun 1 as disclosed by U.S. Patent Application Publication No. 20170190037 includes a main body 11, a muzzle 12 connected to the main body 11 and adapted to be loaded with a nail 2, a lifting wheel 13 rotatably connected to the muzzle 12 and electrical driven, and a nail-striking pin 14 movable within the muzzle 12 and adapted to be driven by an air pressure to strike the nail 2. The nail-striking pin 14 includes a striking portion 141, and a row of engaging teeth 142. The engaging teeth 142 and the striking portion 141 are formed as one piece.

When the lifting wheel 13 is electrically driven to rotate, the nail-striking pin 14 is moved in a direction towards the main body 11 due to engagement between the lifting wheel 13 and the row of engaging teeth 142 and compresses air inside the main body 11. When the lifting wheel 13 is disengaged from the row of engaging teeth 142, the resulting air pressure drives the nail-striking pin 14 away from the main body 11, striking the nail 2 with the striking portion 141.

However, the conventional nail-striking pin 14 has the following drawbacks:

1. The structure of the row of engaging teeth 142 and the striking portion 141 results in the nail-striking pin 14 having a complicated shape that is difficult to produce and results in higher production costs.

2. The striking portion 141 is a consumable part and needs to be replaced often. With the striking portion 141 and the row of engaging teeth 142 formed as one piece, the nail-striking pin 14 would need to be replaced entirely whenever the striking portion 141 needs replacing, unnecessarily replacing the row of engaging teeth 142 and increasing the cost of use of the pneumatic nail gun.

3. The striking portion 141 and the row of engaging teeth 142 have different functions that require different properties in material. However, since the striking portion 141 is formed as one piece with the row of engaging teeth 142, they must be made of the same material which means that compromises has to be made on the property of the material, which may lower the life of the nail-striking pin 14 as a consumable part.

SUMMARY

Therefore, the object of the disclosure is to provide a nail-striking pin device that can alleviate at least one of the drawbacks of the prior art. A pneumatic nail gun with the nail-striking pin device is also provided.

According to one aspect of the disclosure, a nail-striking pin device is adapted for use in a pneumatic nail gun. The pneumatic nail gun includes a main body, a cylinder that is disposed in the main body, a muzzle device that is connected to the cylinder, and a lifting wheel that is connected between the main body and the muzzle device and that is electricity-driven rotatably. The nail-striking pin device includes a piston, a lifting rod, and a nail-striking pin.

The piston is adapted to be disposed in the cylinder, and is movable between a striking position for being proximate to the muzzle device, and a non-striking position for being distal from the muzzle device. Movement of the piston toward the non-striking position is adapted for increasing an air pressure inside the cylinder.

The lifting rod is connected to the piston, and has an engaging portion. The engaging portion is adapted to be engaged movably with the lifting wheel such that rotation of the lifting wheel drives the piston to move to the non-striking position, and to be disengaged from the lifting wheel when the piston is at the non-striking position such that the piston is driven by the air pressure inside the cylinder to move to the striking position.

The nail-striking pin is connected removably and co-movably to the piston, is spaced apart from the lifting rod, and is adapted for striking a nail out of the muzzle device when the piston is at the striking position.

According to another aspect of the disclosure, a pneumatic nail gun includes a main body, a cylinder disposed in the main body, a muzzle device connected to the cylinder, a lifting wheel connected between the main body and the muzzle device and that is electricity-driven rotatably, a piston, a lifting rod, and a nail-striking pin.

The piston is disposed in the cylinder, and is movable between a striking position for being proximate to the muzzle device, and a non-striking position for being distal from the muzzle device. Movement of the piston toward the non-striking position is adapted for increasing an air pressure inside the cylinder.

The lifting rod is connected to the piston, and has an engaging portion. The engaging portion is engaged movably with the lifting wheel such that rotation of the lifting wheel drives the piston to move to the non-striking position, and is disengaged from the lifting wheel when the piston is at the non-striking position such that the piston is driven by the air pressure inside the cylinder to move to the striking position.

The nail-striking pin is connected removably and co-movably to the piston, is spaced apart from the lifting rod, and is disposed for striking a nail out of the muzzle device when the piston is at the striking position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
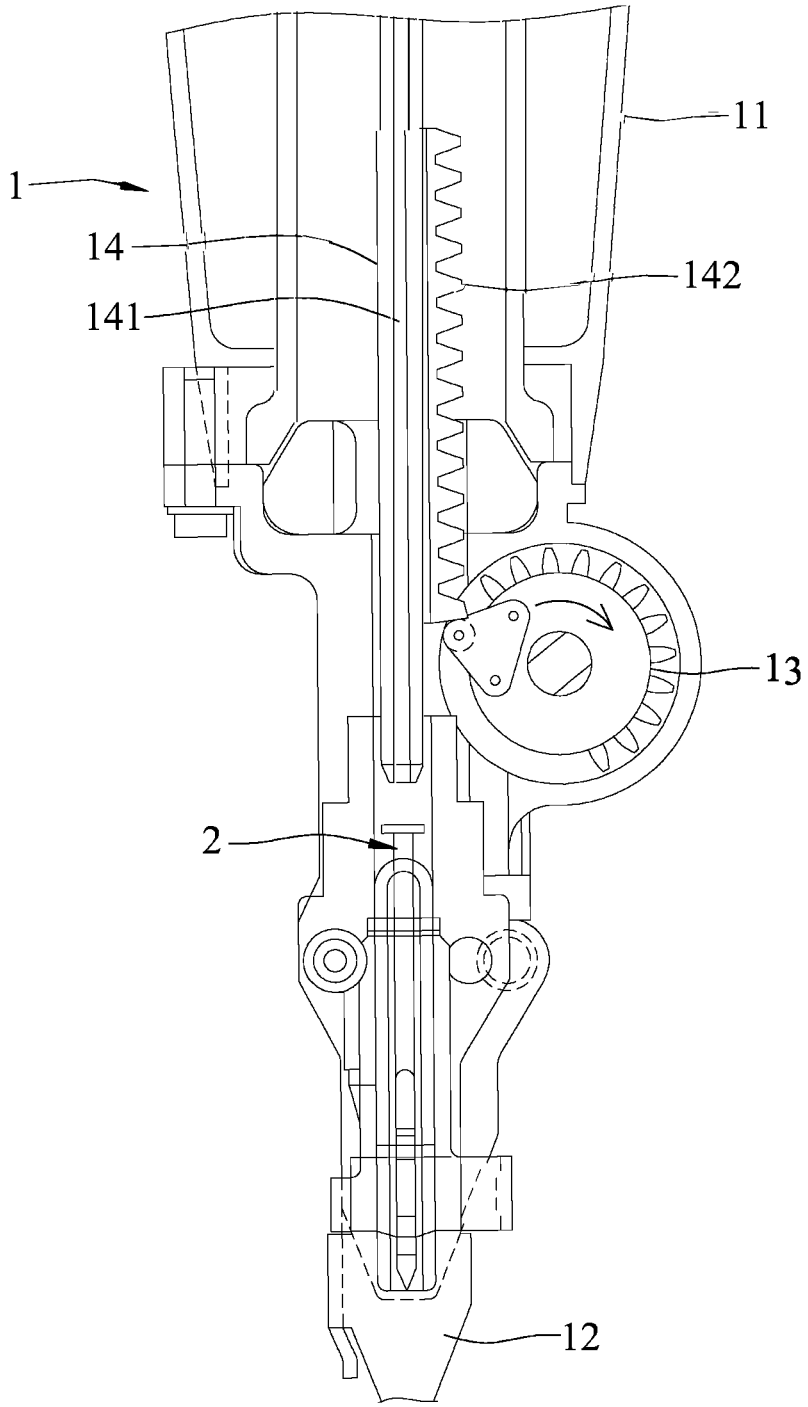
FIG.1 PRIOR ART
FIG. 1 is a fragmentary schematic view of a conventional pneumatic nail gun disclosed in U.S. Patent Application Publication No. 20170190037.
Figure 2:
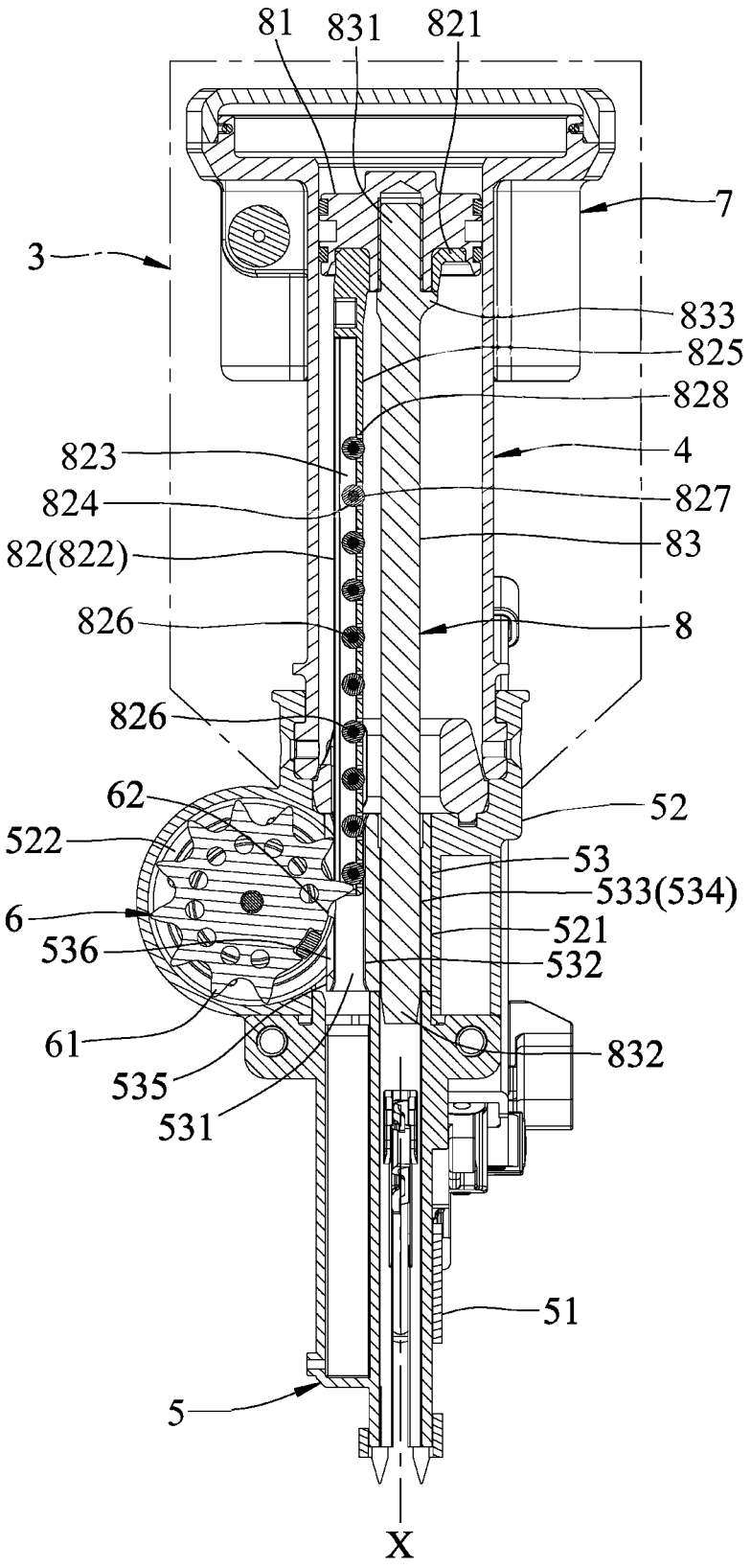
FIG. 2 is a sectional view of an embodiment of a pneumatic nail gun according to the disclosure, illustrating a piston at a non-striking position.
Figure 3:
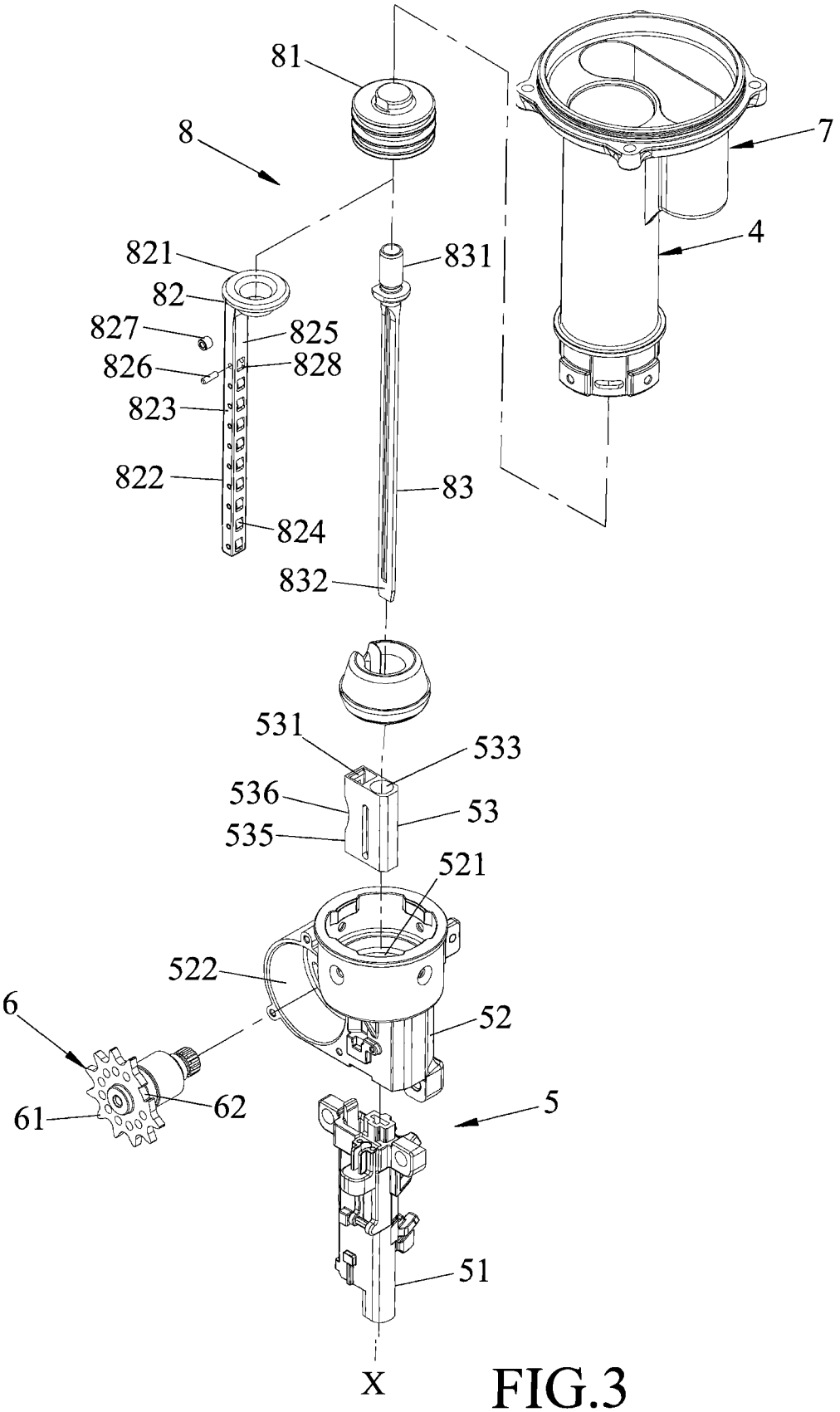
FIG. 3 is an exploded perspective view, illustrating a cylinder, a muzzle device, a lifting wheel, a container and a nail-striking pin device of the embodiment.
Figure 4:
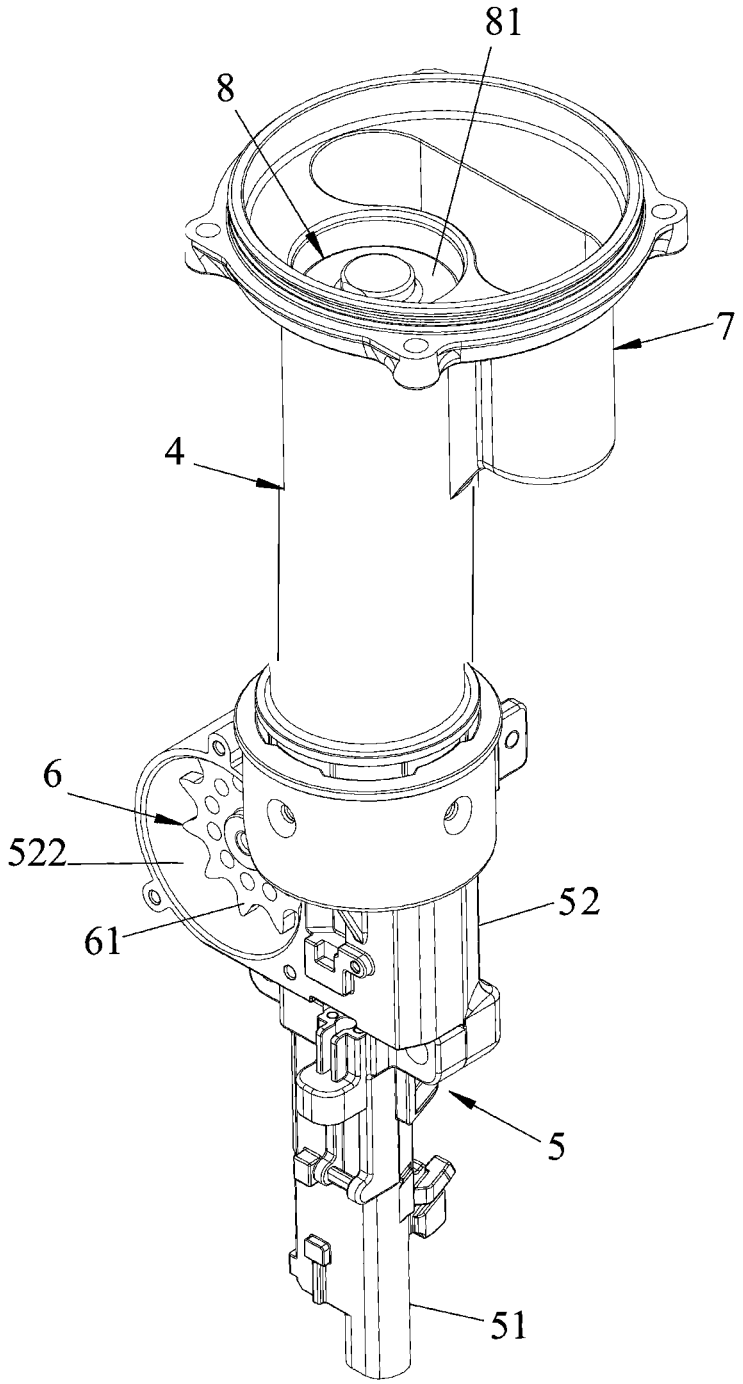
FIG. 4 is an assembled perspective view of the cylinder, the muzzle device, the lifting wheel, the container and the nail-striking pin device of the embodiment.

Referring to FIGS. 2 to 4, an embodiment of a pneumatic nail gun according to the disclosure includes a main body 3, a cylinder 4 disposed in the main body 3, a muzzle device 5 connected to the cylinder 4, a lifting wheel 6, a container 7, and a nail-striking device 8.

The muzzle device 5 includes a muzzle 51 adapted to be loaded with a nail (not shown), and a base seat unit that includes a base seat 52 and a guide member 53. During operation of the embodiment of the pneumatic nail gun, the nail-striking pin device 8 strikes the nail out of the muzzle device 51 along a nail-striking axis (X).

The base seat 52 interconnects the muzzle 51 and the cylinder 4 and defines a main channel 521 extending in a direction of the nail-striking axis (X), and a receiving space 522 disposed at a lateral side of the main channel 521 and being in spatial communication with the main channel 521.

The guide member 53 is disposed in the main channel 521 and has a slide surface 532 extending along the direction of the nail-striking axis (X), and defining a first channel 531 extending along the direction of the nail-striking axis (X). The guide member 53 further has an inner surface 534 defining a second channel 533 that extends along the nail-striking axis (X). The guide member 53 further has an outer surface 535 surrounding the first and second channels 531, 533, and a notch 536 extending from the outer surface 535 to the first channel 531.

The lifting wheel 6 is disposed rotatably in the receiving space 522 of the base seat 52, is connected between the main body 3 and the muzzle device 5, and is electricity-driven rotatably. In this embodiment, the lifting wheel 6 is electrically driven to only rotate unidirectionally, in an anticlockwise direction. The lifting wheel 6 has a toothed circumferential portion 61 and a smoothed circumferential portion 62.

The container 7 is disposed in the main body 3 and in spatial communication with the cylinder 4 for storing gas of a predetermined pressure.

Figure 5:
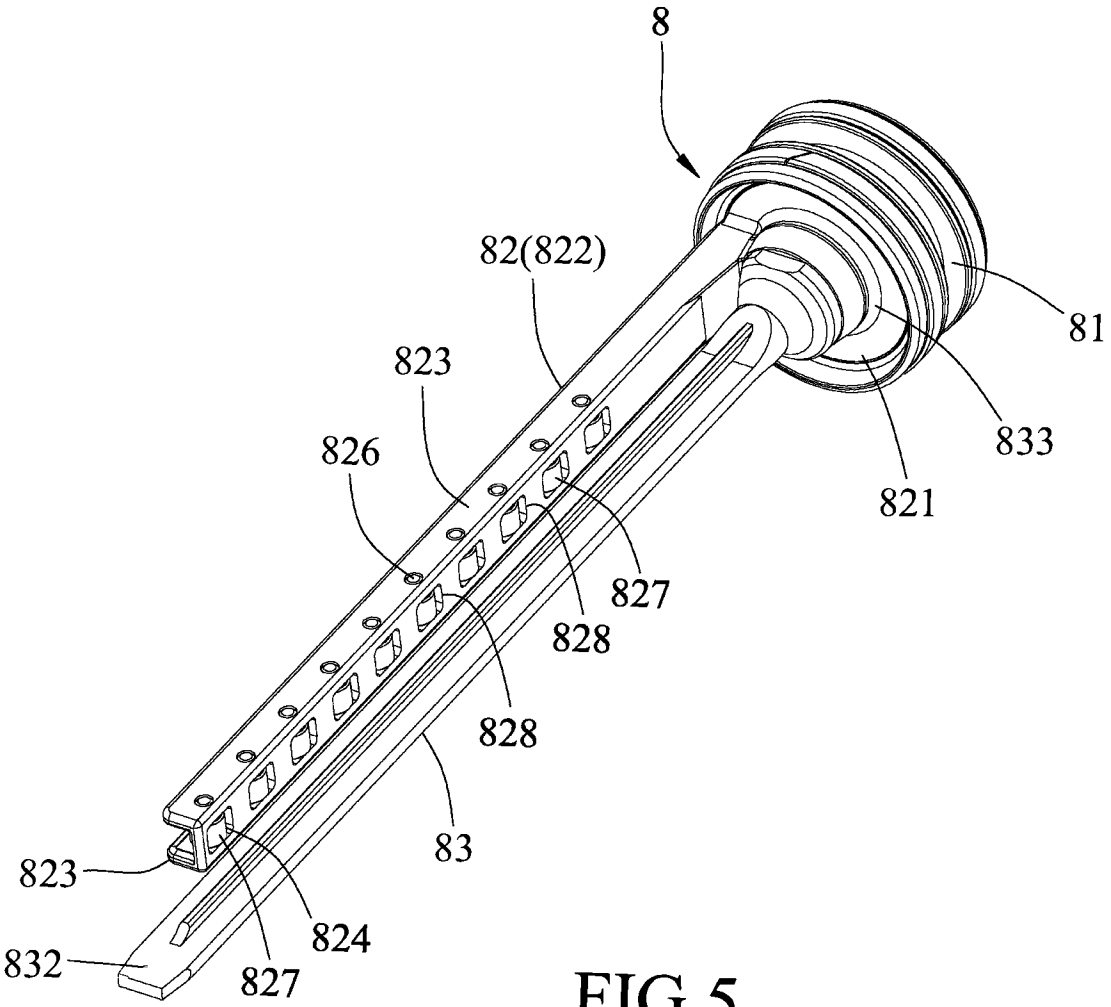
FIG. 5 is a perspective view of the nail-striking pin device of the embodiment.
Figure 6:
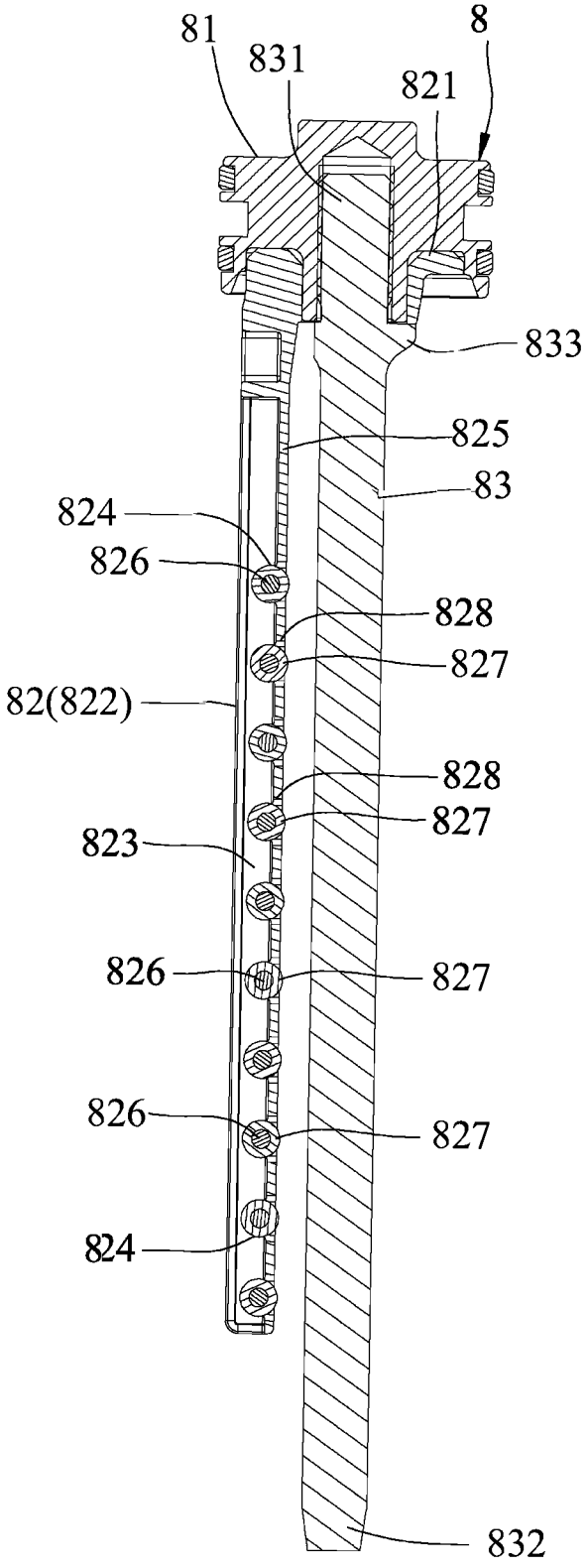
FIG. 6 is a sectional view of the nail-striking pin device of the embodiment.

Referring to FIGS. 2, 5, and 6, the nail-striking device 8 includes a piston 81, a lifting rod 82 and a nail-striking pin 83.

Figure 8:
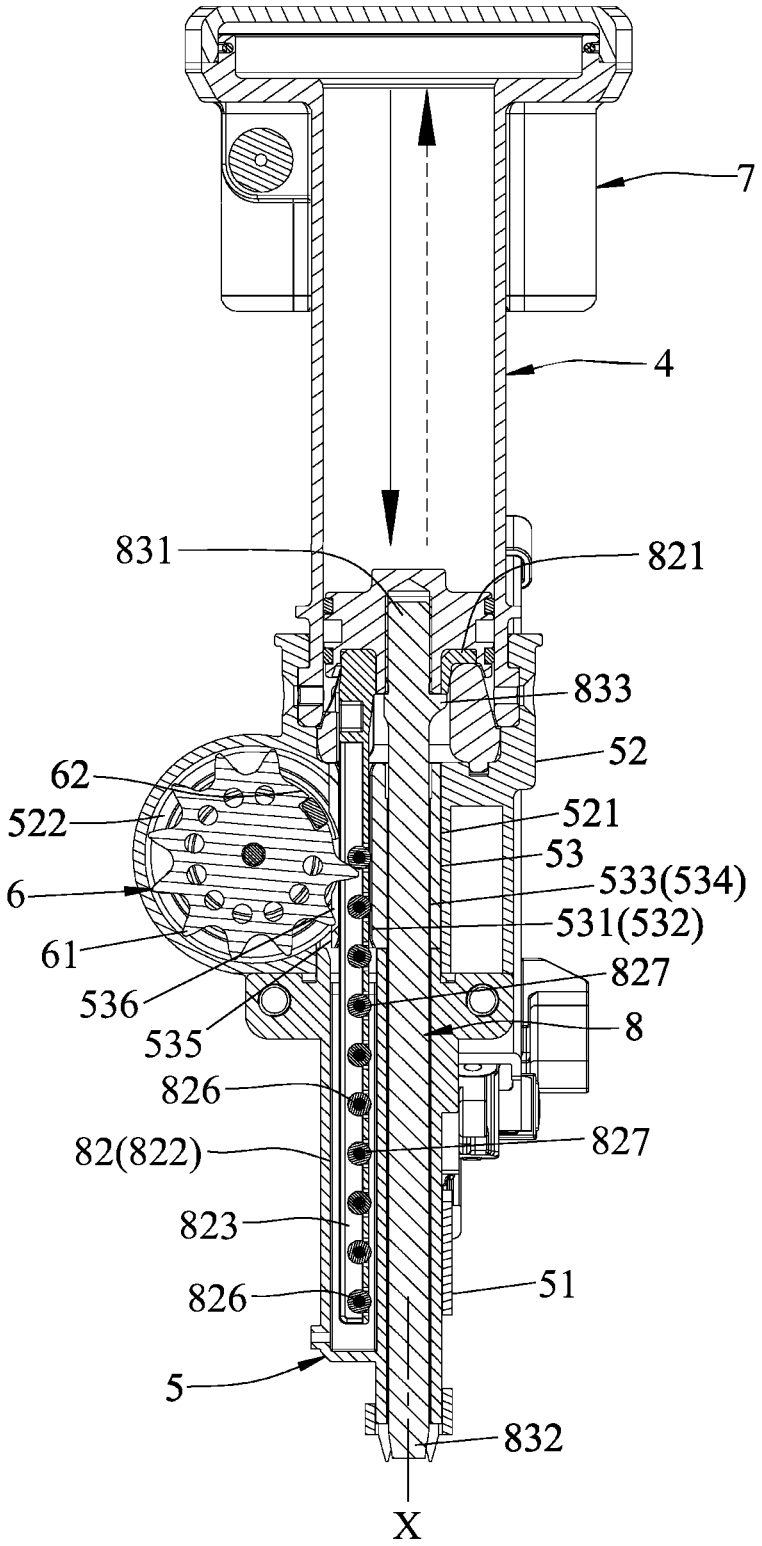
FIG. 8 is a sectional view similar to FIG. 2, but illustrating the piston at the striking position.

The piston 81 is disposed in the cylinder 4, contacts an inner wall of the cylinder sealingly and is movable along the nail-striking axis (X) between a striking position (as shown in FIG. 8) for being proximate to the muzzle device 5, and a non-striking position (as shown in FIG. 2) for being distal from the muzzle device 5.

The lifting rod 82 is connected removably to the piston 81. Specifically, the lifting rod 82 has a ring portion 821 that is secured removably to the piston 81, and an engaging portion 822 that extends in the direction of the nail-striking axis (X) movably into the first channel 531. The engaging portion 822 has two spaced-apart plate segments 823 extending from the ring portion 821 in the direction of the nail-striking axis (X), a plurality of spaced-apart engaging teeth 824, and a strip segment 825 interconnecting the plate segments 823. The strip segment 825 has a plurality of through holes 828. The engaging teeth 824 are connected rotatably between the plate segments 823. Each of the engaging teeth 824 includes a shaft 826 that is connected between the plate segments 823, and a rotary body 827 that is substantially cylindrical, that is sleeved rotatably on the shaft 826, that extend through a respective one of the through holes 828 and that is in rotatable contact with the slide surface 532.

The nail-striking pin 83 is connected removably and co-movably to the piston 81, is spaced apart from the lifting rod 82, extends along the nail-striking axis (X) and movably through the second channel 533, and is disposed for striking the nail out of the muzzle device 5 when the piston 8 is at the striking position. The nail-striking pin 83 has a connecting portion 831, a striking portion 832 and an abutment portion 833. The connecting portion 831 extends through the ring portion 821 of the lifting rod 82 and is connected removably and co-movably to the piston 81. The striking portion 832 is opposite to the connecting portion 831 and adapted for contacting the nail. The abutment portion 833 is disposed between the connecting portion 831 and the striking portion 832, and abuts removably against the ring portion 822 of the lifting rod 82 for securing removably the lifting rod 82 to the piston 81.

Referring to FIGS. 2 and 8, when the lifting wheel 6 is driven electrically to rotate, the plurality of spaced-apart engaging teeth 824 are engaged with the toothed circumferential portion 61 of the lifting wheel 6 which extends into the first channel 531 via the notch 536, driving the lifting rod 82 to move, which further drives the piston 81 to move to the non-striking position (as shown in FIG. 2). In the process of moving towards the non-striking position, the rotary bodies 827 are in rotatable contact with the slide surface 532, smoothing the movement of the nail-striking pin device 8. The piston 8 compresses gas in the cylinder 4 into the container 7, thereby increasing the gas pressure inside the container 7. As the piston 81 reaches the non-striking position, the toothed circumferential portion 61 of the lifting wheel 6 is engaged with one of the engaging teeth 824 which is farthest from the ring portion 821. Since the lifting wheel 6 is unidirectionally rotatable, the piston 81 is kept in the non-striking position.

Figure 7:
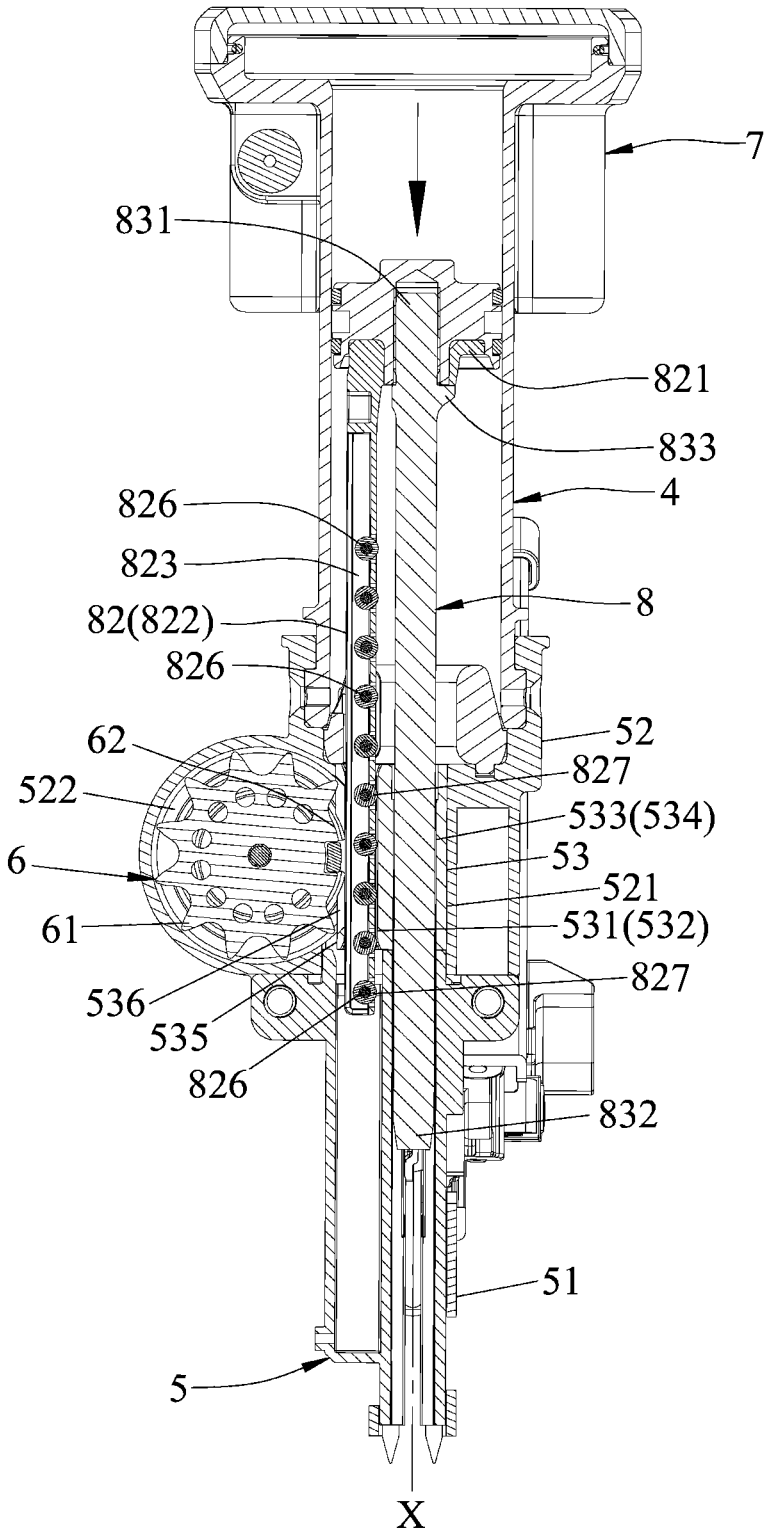
FIG. 7 is a sectional view similar to FIG. 2, but illustrating a piston moving from the non-striking position toward a striking position.

Referring to FIGS. 2, 7 and 8, when the pneumatic nail gun is activated, the lifting wheel 6 is further rotated electrically the plurality of spaced-apart engaging teeth 824 face the smoothed circumferential portion 62 of the lifting wheel 6 such that engaging portion 822 is disengaged from the lifting wheel 6. At this point, the gas pressure inside the container 7 and the cylinder 4 drives the piston 81 towards the striking position. During this movement, the striking segment 832 of the nail-striking pin 83 moves along the nail-striking axis (X) in the second channel 533 towards the muzzle 51 to strike the nail.

To sum up, to move the piston 81 towards and to hold the piston 81 at the non-striking position, the lifting wheel 6 is electrically driven to rotate until the lifting wheel 6 is engaged with the one of the engaging teeth 824 which is farthest from the ring portion 821. To move the piston 81 towards the striking position, the lifting wheel 6 is again electrically driven to rotate so that the engaging teeth 824 face the smooth circumferential portion 62 of the lifting wheel 6, causing the engaging segment 822 and the lifting wheel 6 to become disengaged. Thus, the gas pressure in the container 7 and the cylinder 4 resulting from the piston 81 moving into the striking position is allowed to drive the piston 81, along with the nail-striking pin 83, to move towards the striking position, striking the nail.

The benefits of the embodiment of the pneumatic nail gun with the nail-striking pin device 8 are as follows:

1. The design of the lifting rod 82 is not limited by the design of the nail-striking pin 83.

2. Since the lifting rod 82 and the nail-striking pin 83 are two independent and separable parts, they may be replaced separately, decreasing unnecessary changing of parts.

3. Since the nail-striking pin 83 and the lifting rod 82 are not formed in one piece, they may be made of different materials appropriate for different functions, thereby increasing lifespan of both the nail-striking pin 83 and the lifting rod 82.

4. The inclusion of the guide member 53 allows the rotary bodies 827 of the engaging teeth 824 to be in rotatable contact with the slide surface 532 of the guide member 53 as the lifting rod 82 moves, thereby smoothing the movement.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A nail-striking pin device adapted for use in a pneumatic nail gun, the pneumatic nail gun including a main body, a cylinder that is disposed in the main body, a muzzle device that is connected to the cylinder, and a lifting wheel that is connected between the main body and the muzzle device and that is electricity-driven rotatably, said nail-striking pin device comprising:

a piston that is adapted to be disposed in the cylinder, and that is movable between a striking position for being proximate to the muzzle device, and a non-striking position for being distal from the muzzle device, movement of said piston toward the non-striking position being adapted for increasing an air pressure inside the cylinder;

a lifting rod that is connected to said piston, and that has an engaging portion adapted to be engaged movably with the lifting wheel such that rotation of the lifting wheel drives said piston to move to the non-striking position, and adapted to be disengaged from the lifting wheel when said piston is at the non-striking position such that said piston is driven by the air pressure inside the cylinder to move to the striking position; and a nail-striking pin comprising a connecting portion that is connected removably and co-moveably to said piston and a striking portion that is opposite to said connecting portion and that is spaced apart from said lifting rod such that it is not in direct contact with said lifting rod, the nail-striking pin being adapted for striking a nail out of the muzzle device when said piston is at the striking postion.

2. The nail-striking pin device as claimed in claim 1, wherein:

said piston is movable along a nail-striking axis between the striking position and the non-striking position;

said nail-striking pin extends along the nail-striking axis; and said lifting rod is connected removably to said piston, extends in a direction of the nail-striking axis, and has a plurality of spaced-apart engaging teeth that are adapted to be engaged with a toothed circumferential portion of the lifting wheel during the movement of said piston toward the non-striking position, and that are adapted to face a smoothed circumferential portion of the lifting wheel to be disengaged from the lifting wheel during the movement of said piston from the non-striking position to the striking position.

3. The nail-striking pin device as claimed in claim 2, wherein:

said lifting rod further has two plate segments that extend in the direction of the nail-striking axis and that are spaced apart from each other; and said engaging teeth are connected rotatably between said plate segments.

4. The nail-striking pin device as claimed in claim 3, wherein each of said engaging teeth includes a shaft that is connected between said plate segments, and a rotary body that is sleeved rotatably on said shaft.

5. The nail-striking pin device as claimed in claim 3, wherein:

said lifting rod further has a ring portion that is secured removably to said piston; and said plate segments of said engaging portion extend in the direction of the nail-striking axis from said ring portion.

6. The nail-striking pin device as claimed in claim 5, wherein:

the connecting portion of said nail-striking pin extends through said ring portion of said lifting rod; the striking portion of said nail-striking pin is adapted for contacting the nail; and the nail-striking pin further comprises an abutment portion that is disposed between said connecting portion and said striking portion, and that abuts removably against said ring portion of said lifting rod for securing removably said lifting rod to said piston.

7. A pneumatic nail gun comprising:

a main body;

a cylinder disposed in said main body;

a muzzle device connected to said cylinder;

a lifting wheel connected between said main body and said muzzle device and that is electricity driven rotatably;

a piston disposed in said cylinder, and being movable between a striking position for being proximate to said muzzle device, and a non-striking position for being distal from said muzzle device, movement of said piston toward the non-striking position being adapted for increasing an air pressure inside said cylinder;

a lifting rod connected to said piston, and having an engaging portion that is engaged movably with said lifting wheel such that rotation of said lifting wheel drives said piston to move to the non-striking position, and that is disengaged from said lifting wheel when said piston is at the non-striking position such that said piston is driven by the air pressure inside said cylinder to move to the striking position; and a nail-striking pin comprising a connecting portion that is connected removably and co-movably to said piston and a striking portion that is opposite to said connecting portion and that is spaced apart from said lifting rod such that it is not in direct contact with said lifting rod, the nail-striking pin being adapted or striking a nail out of the muzzle device when said piston is at the striking position.

8. The pneumatic nail gun as claimed in claim 7, wherein:

said lifting wheel has a toothed circumferential portion and a smooth circumferential portion;

said piston is movable along a nail-striking axis between the striking position and the non-striking position;

said nail-striking pin extends along the nail-striking axis; and said lifting rod is connected removably to said piston, extends in a direction of the nail-striking axis, and has a plurality of spaced-apart engaging teeth that are engaged with said toothed circumferential portion of said lifting wheel during the movement of said piston toward the non-striking position, and that face said smoothed circumferential portion of said lifting wheel to be disengaged from said lifting wheel during the movement of said piston from the non-striking position to the striking position.

9. The pneumatic nail gun as claimed in claim 8, wherein:

said lifting rod further has two plate segments that extend in the direction of the nail-striking axis and that are spaced apart from each other;

said engaging teeth are connected rotatably between said plate segments; and each of said engaging teeth includes a shaft that is connected between said plate segments, and a rotary body that is sleeved rotatably on said shaft.

10. The pneumatic nail gun as claimed in claim 9, wherein said muzzle device includes:

a muzzle; and a base seat unit that interconnects said muzzle and said cylinder, and that has a slide surface extending along the direction of the nail-striking axis, said rotary bodies of said engaging teeth being in rotatable contact with said slide surface.

11. The pneumatic nail gun as claimed in claim 10, wherein:

said slide surface defines a first channel that extends along the direction of the nail-striking axis;

said base seat unit of said muzzle device further has an inner surface that defines a second channel, an outer surface that surrounds said first and second channels, and a notch that extends from said outer surface to said first channel;

said lifting rod extends movably into said first channel;

said nail-striking pin extends movably through said second channel; and said toothed circumferential portion of said lifting wheel extends into said first channel via said notch during the movement of said piston toward the non-striking position.

12. The pneumatic nail gun as claimed in claim 10, wherein:

said base seat unit includes a base seat that defines a main channel extending in the direction of the nail-striking axis, and a receiving space disposed at a lateral side of said main channel and being in spatial communication with said main channel, and a guide member that is disposed in said main channel, and that has said slide surface, said inner surface, said outer surface and said notch; and said lifting wheel is disposed rotatably in said receiving space of said base seat.

13. The pneumatic nail gun as claimed in claim 9, wherein:

said lifting rod further has a ring portion that is secured removably to said piston; and said plate segments of said engaging portion extend in the direction of the nail-striking axis from said ring portion.

14. The pneumatic nail gun as claimed in claim 13, wherein:

the connecting portion of said nail-striking pin extends through said ring portion of said lifting rod; the striking portion of said nail-striking pin is adapted for contacting the nail; and the nail-striking pin further comprises an abutment portion that is disposed between said connecting portion and said striking portion, and that abuts removably against said ring portion of said lifting rod for securing removably said lifting rod to said piston.

* * * * *